US006035558A

United States Patent [19]

Okajima

[11] Patent Number: 6,035,558

[45] Date of Patent: Mar. 14, 2000

[54] SNOWBOARD BOOT

[75] Inventor: Shinpei Okajima, Izumi, Japan

[73] Assignee: Shimano, Inc., Osaka, Japan

[21] Appl. No.: 09/151,613

[22] Filed: Sep. 11, 1998

Related U.S. Application Data

[63] Continuation-in-part of application No. 08/736,233, Oct. 23, 1996.

[51] Int. Cl.[7] ..... A43B 5/04; A43B 7/14; A43B 7/20

[52] U.S. Cl. ..... 36/117.1; 36/117.2; 36/118.2; 36/89; 36/93

[58] Field of Search ..... 36/117.1, 117.2, 36/117.4, 117.6, 118.2, 118.7, 118.8, 118.9, 89, 93

[56] References Cited

U.S. PATENT DOCUMENTS

| | | | |
|---|---|---|---|
| 746,338 | 12/1903 | Keen | 36/89 |
| 2,531,763 | 11/1950 | Andre | 36/117.8 |
| 2,789,374 | 4/1957 | Planert | 36/89 |
| 2,942,359 | 6/1960 | Bushway et al. | 36/89 |
| 3,529,369 | 9/1970 | Drago | 36/118.2 |
| 4,509,276 | 4/1985 | Bourque | 36/115 |
| 5,109,613 | 5/1992 | Van Dyke | 36/89 |
| 5,722,187 | 3/1998 | Pamio et al. | 36/88 |
| 5,784,809 | 7/1998 | McDonald | 36/117.5 |

FOREIGN PATENT DOCUMENTS

| | | | |
|---|---|---|---|
| 117372 | 9/1984 | European Pat. Off. | 36/115 |
| 0 317 798 A2 | 5/1989 | European Pat. Off. | A43B 5/04 |
| 820706 | 11/1951 | Germany | 36/117.6 |

*Primary Examiner*—Paul T. Sewell
*Assistant Examiner*—Anthony Stashick
*Attorney, Agent, or Firm*—James A. Deland

[57] ABSTRACT

A snowboard boot includes a foot portion, an ankle portion formed of a flexible material disposed above the foot portion and extending forwardly for covering an anklebone, and a leg portion disposed above the ankle portion. The ankle portion includes a first stitch line extending from a rear of the ankle portion forwardly and a second stitch line extending from the rear of the ankle portion forwardly so that the flexible material forms a flexible material space extending from between the first stitch line and the second stitch line for covering the anklebone. The flexible material space has no stitch line extending from the rear of the ankle portion therein to comfortably accommodate the anklebone.

20 Claims, 5 Drawing Sheets

SNOWBOARD BOOT

CROSS REFERENCE TO RELATED APPLICATION

This application is a continuation-in-part of application Ser. No. 08/736,233 entitled "Snowboard Boot" filed on Oct. 23, 1996.

BACKGROUND OF THE INVENTION

The present invention is directed to snowboard boots and, more particularly, to a snowboard boot capable of longitudinal and/or lateral inclination.

The snowboarding World Cup is a competition based on points, and it is divided into Alpine competition (comprising slalom and downhill runs) and freestyle competition (comprising half-pipe and mogul runs). The boots used in Alpine competition are designed such that the attitude of the legs of the user are fixed with respect to the snowboard. However, ankle flexibility in both the longitudinal and lateral direction is required in the half-pipe competition.

Copending application Ser. No. 08/736,233 entitled "Snowboard Boot" filed on Oct. 23, 1996 and incorporated herein by reference discloses various snowboard boots having longitudinal and lateral flexibility. For example, as shown in FIG. 1, a snowboard boot disclosed in that application is made up of a sole component 1, a toe component 2, a heel component 3, and a leg component 4. The leg component is generally formed in a roughly cylindrical shape. The characteristic anklebone position is indicated by point K. "Anklebone" refers to the protruding portion that projects from the left and right sides of the ankle. In this specification, this left and right direction is called the lateral direction. The lateral direction that passes through the anklebone is called the direction of the anklebone axis. The ankle rotates with this anklebone axis as its approximate center. The anklebone axis will hereinafter be referred to as the K axis. Of the rotation around this K axis, that is, the rotation of the leg component 4 with respect to the sole 1, the rotation in the direction in which the top of the leg component 4 goes toward the toe component 2 is called forward inclination. In contrast, the rotational movement of the leg component with respect to the boot sole around the longitudinal axis that links the heel component and the toe component) in the horizontal direction perpendicular to the K axis is called swinging.

In the disclosed embodiment, the boot sole 1 is equipped with a liner (not shown) molded from a hard resin. The stiff heel portion 5 (called a heel cup) makes up a portion of the heel component 3, either integrally with or independently from the liner. The stiff heel portion 5 shares the curved shape of the heel component 3. The stiff heel portion 5 can be molded as a riser portion that rises continuously to the portion extending over the boot sole 1, and it can also be provided independently of a so-called heel cup. The stiff heel portion 5 is molded such that it is exposed on the outside of the boot, but can also be molded such that it is on the inside and cannot be seen. A stiff leg portion 6 forms part of the leg component 4 at the top of the stiff heel portion 5, which is part of the heel cup.

A stiff heel overlap portion 7 is coupled to the stiff heel portion 5 via rivets 7*a*, and a stiff leg overlap portion 8 is coupled to the stiff leg portion 6 via rivets 8*a*. The stiff heel overlap portion 7 overlaps the stiff leg overlap portion 8 in the longitudinal direction. The stiff heel overlap portion 7 and the stiff leg overlap portion 8 are fixed such that they can move in the vertical direction relative to each other, and such that they can rotate relative to each other around the longitudinal direction a. The stiff heel overlap portion 7 and the stiff leg overlap portion 8 are rotatably fixed by the pivot pin 9.

A cover portion is formed by an accordion-shaped portion 15 of a flexible material that wraps around the back of the Achilles tendon, and a cut-out 16 is formed over the accordion-shaped portion 15. As a result, flexible portion 15 and cut-out 16 promote lateral and longitudinal flexing of leg component 4 relative to heel component 3. The present invention is directed to an improvement in the construction of cut-out 16 and flexible material 15 to accommodate stresses placed on the boot during use.

SUMMARY OF THE INVENTION

The present invention is directed to a snowboard boot with longitudinal and lateral flexibility, wherein a portion of the boot covering the anklebone is flexible enough to accommodate desired longitudinal and lateral motion while having sufficient durability to withstand damage and undesirable forward stretching during use. In one embodiment of the present invention, a snowboard boot includes a foot portion, an ankle portion formed of a flexible material disposed above the foot portion and extending forwardly for covering an anklebone, and a leg portion disposed above the ankle portion. The ankle portion includes a first stitch line extending from a rear of the ankle portion forwardly and a second stitch line extending from the rear of the ankle portion forwardly so that the flexible material forms a flexible material space extending from between the first stitch line and the second stitch line for covering the anklebone. Preferably the flexible material space has no stitch line extending from the rear of the ankle portion therein to comfortably accommodate the anklebone.

In a more specific embodiment, the flexible material comprises a fabric, and the stitch lines are exposed to the outside of the boot. If desired, the first stitch line may extend from the rear of the ankle portion forwardly and upwardly, and the second stitch line may extend from the rear of the ankle portion forwardly and downwardly to form the fabric space to cover the anklebone. An arcuate-shaped pad may be stitched to the ankle portion to support the area behind the anklebone.

DETAILED DESCRIPTION OF THE EMBODIMENTS

Figure 2:
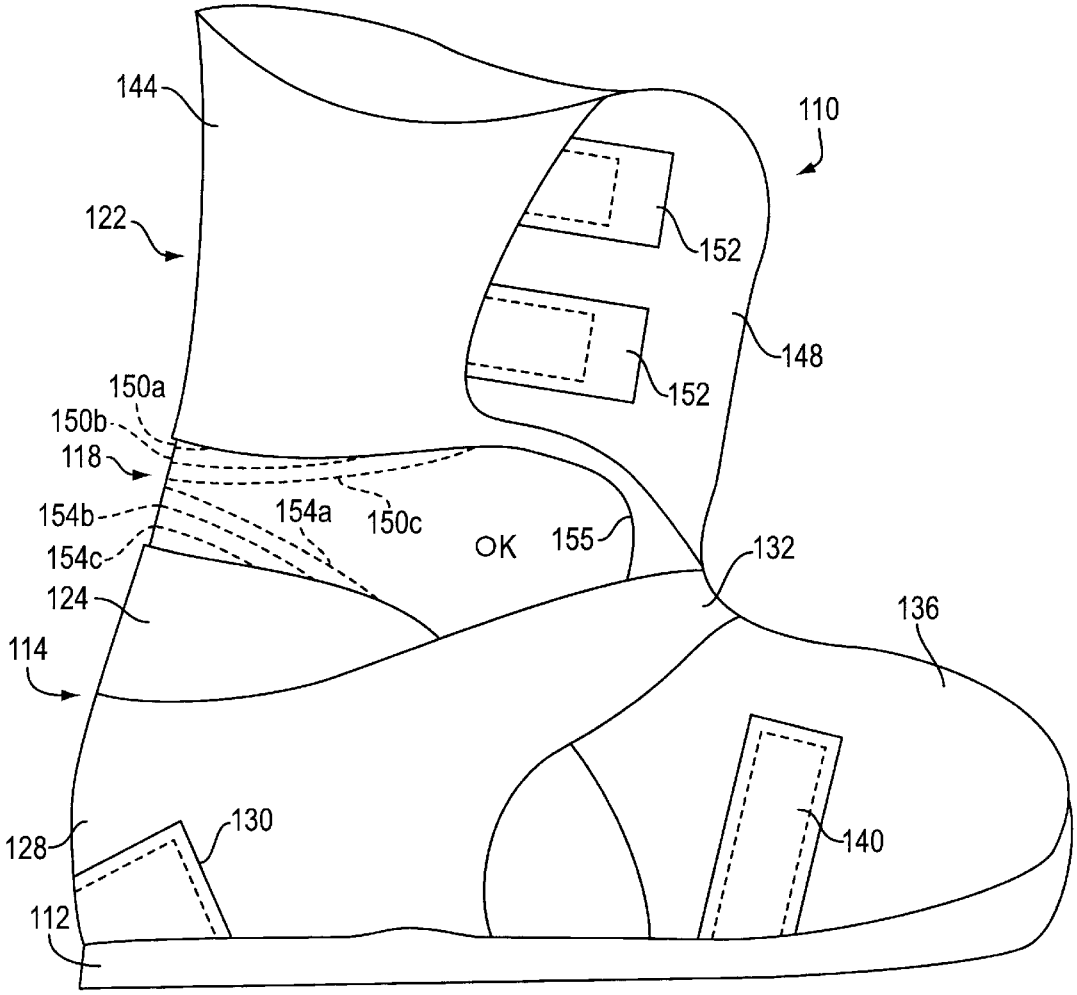
FIG. 2 is a side view of a particular embodiment of relevant parts of a snowboard boot according to the present invention.

FIG. 2 is a side view of a particular embodiment of a portion of a snowboard boot 110 according to the present invention. Snowboard boot 110 includes a sole 112, a foot portion 114, an ankle portion 118 formed of a flexible material disposed above the foot portion 114 and extending forwardly for covering an anklebone positioned at the location K, and a leg portion 122 disposed above the ankle portion 118. A liner (not shown) is usually placed inside the boot for added support and comfort.

Foot portion 114 includes an inner heel cup 124, an outer heel cup 128, and a toe portion 136. In this embodiment inner heel cup 124 extends horizontally below the heel and upwardly around the sides and back of the heel to a position below the level of the location K. Inner heel cup 124 may be constructed from a flexible but durable material such as leather, and it may be stitched, bonded, etc. to sole 112. Outer heel cup 128 extends upwardly around the sides and back of inner heel cup 124. Outer heel cup 128 may be formed from leather, and a portion of outer heel cup 128 may extend toward the instep to form an instep reinforcement band 132. As with inner heel cup 124, outer heel cup 128 also may be attached to the sole 112 by stitching, bonding, etc. A conventional adjustable instep strap (not shown) may be attached to a strap attachment portion 130 for passing around instep reinforcement band 132 to the other side of the boot. Toe portion 136 extends upwardly around the sides, front and top of the foot. Toe portion 136 also may be formed from leather, and it may be attached to the sole 112 by stitching, bonding, etc. In this embodiment, inner heel cup 124, outer heel cup 128 and/or toe portion 136 may be stitched together at overlapping borders thereof. Toe strap attachment portions 140 may be formed on opposite sides of toe portion 136 for attachment of an adjustable toe strap (not shown).

Leg portion 122 includes a rear leg support 144 and a front leg support 148 which, in this embodiment, is separate from rear leg support 144 and forms a conventional tongue. Rear leg support 144 and front leg support 148 both may be formed from a flexible but durable material such as leather and/or cordura® nylon. If desired, front leg portion 148 may be formed as one piece with toe portion 136. Alternatively, front leg portion may be stitched to the toe portion 136 so as to form the upper surface of toe portion 136. Fastening strap attachment portions 152 for attachment of adjustable fastening straps (not shown) for securing rear leg support 144 and front leg support 148 to the leg in a known manner may be formed on rear leg portion 148. Rear leg support 144 has a cut-out 155 that encircles the anklebone for avoiding pressure points on the anklebone.

Ankle portion 118 is disposed between foot portion 114 and leg portion 122, and it extends around the back of boot 110 and forwardly on opposite sides of boot 110 for covering the anklebone. Ankle portion 118 may be formed as one piece from a flexible material such as a cordura® nylon fabric or some other material that allows longitudinal and lateral pivoting of leg portion 122 relative to foot portion 114, and it is preferably stitched to the overlapping portions of inner heel cup 124, instep band 132, rear leg portion 144 and toe portion 136.

Figure 3:
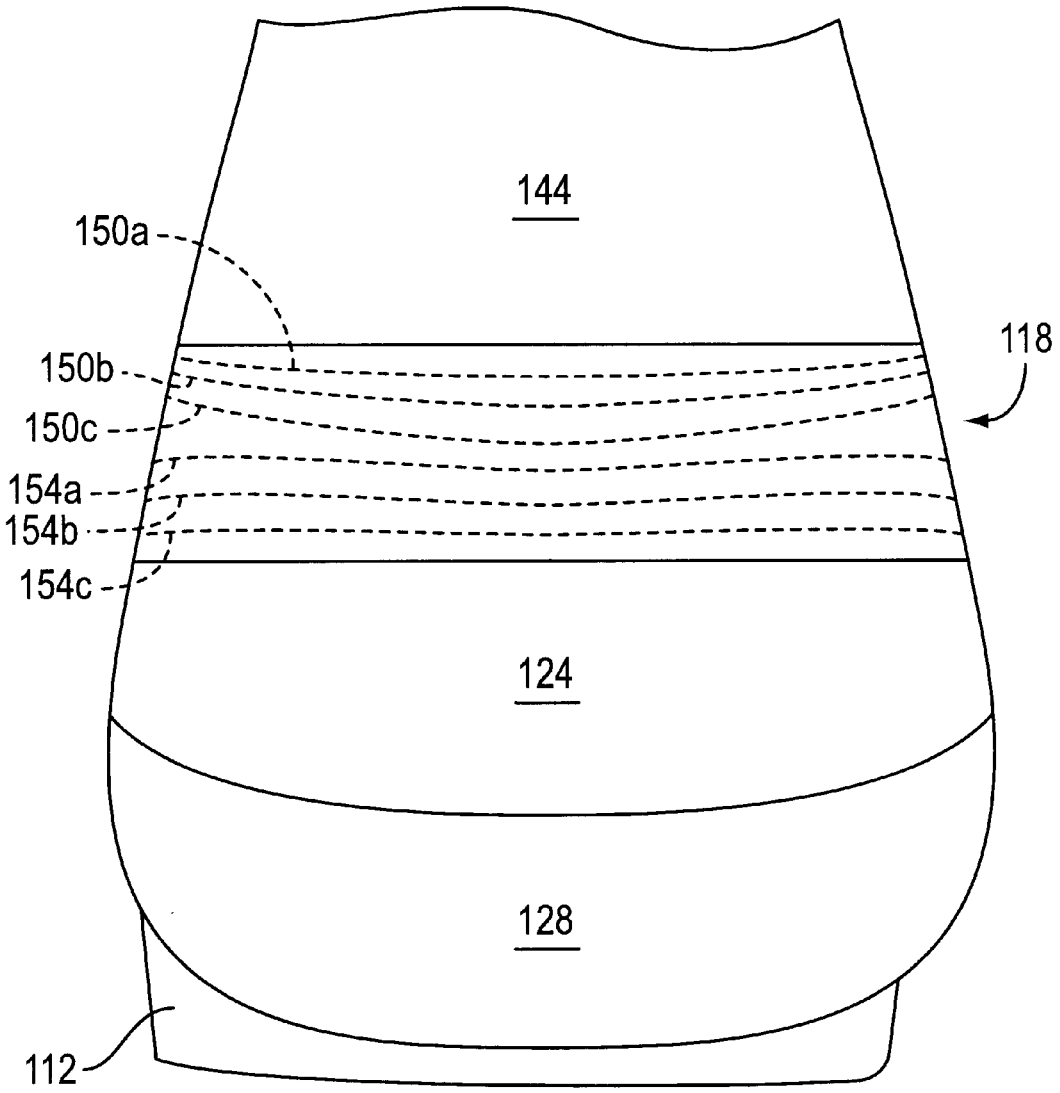
FIG. 3 is a rear view of the snowboard boot according to the present invention.
Figure 4:
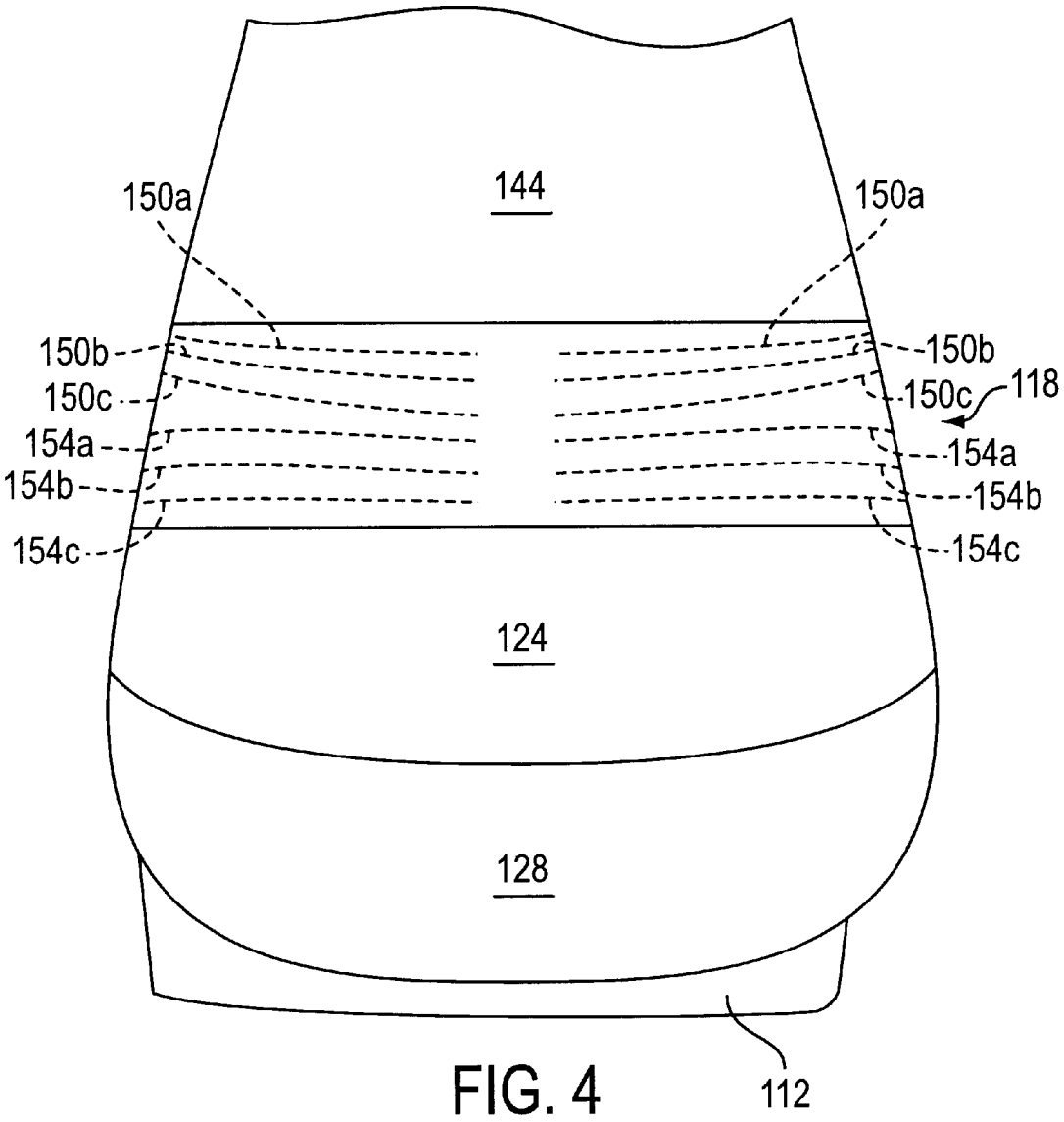
FIG. 4 is a rear view of an alternative embodiment of a snowboard boot according to the present invention.

Although it is desirable to have lateral and longitudinal pivoting of leg portion 122 relative to foot portion 114, it is not desirable to have horizontal stretching of ankle portion 118 which results in unwanted forward movement of the heel including heel lift during toe-side turns. To accommodate the desired lateral and longitudinal pivoting while preventing unwanted horizontal stretching, a plurality of first stitch lines 150*a,* 150*b* and 150*c* extend from a rear of the ankle portion forwardly, and a plurality of second stitch lines 154*a,* 154*b* and 154*c* extend from the rear of the ankle portion forwardly, wherein stitch lines 150*a,* 150*b,* 150*c,* 154*a*, 154*b* and 154*c* inhibit horizontal stretching while allowing vertical stretching. In this embodiment, the plurality of first stitch lines 150*a,* 150*b* and 150*c* extend from the rear of the ankle portion forwardly and upwardly, and the plurality of second stitch lines 154*a,* 154*b* and 154*c* extend from the rear of the ankle portion forwardly and downwardly so that the flexible material forms a flexible material space extending from between the plurality of first stitch lines 150*a,* 150*b* and 150*c* and the plurality of second stitch lines 154*a,* 154*b* and 154*c* for covering the anklebone. Thus, in this embodiment the flexible material space has no stitch line extending from the rear of the ankle portion therein so that maximum flexibility may be retained at the anklebone without causing discomfort. The stitch lines are exposed to the outside of boot 110. The plurality of stitches 150*a,* 150*b,* 150*c,* 154*a,* 154*b* and 154*c* may extend continuously around the back of ankle portion 118 as shown in FIG. 3, or the stitch lines may be discontinuous at the rear as shown in FIG. 4. The stitches also may be discontinuous at the sides as long as the inhibition of horizontal stretching of ankle portion 118 is not excessively compromised. The plurality of stitch lines also may be formed as a series of stepped partial stitch lines, again as long as the inhibition of horizontal stretching of ankle portion 118 is not excessively compromised. Decorative stitching or labeling may be placed in the fabric space covering the anklebone as long as the comfort and biomechanics of the anklebone are not compromised.

Figure 1:
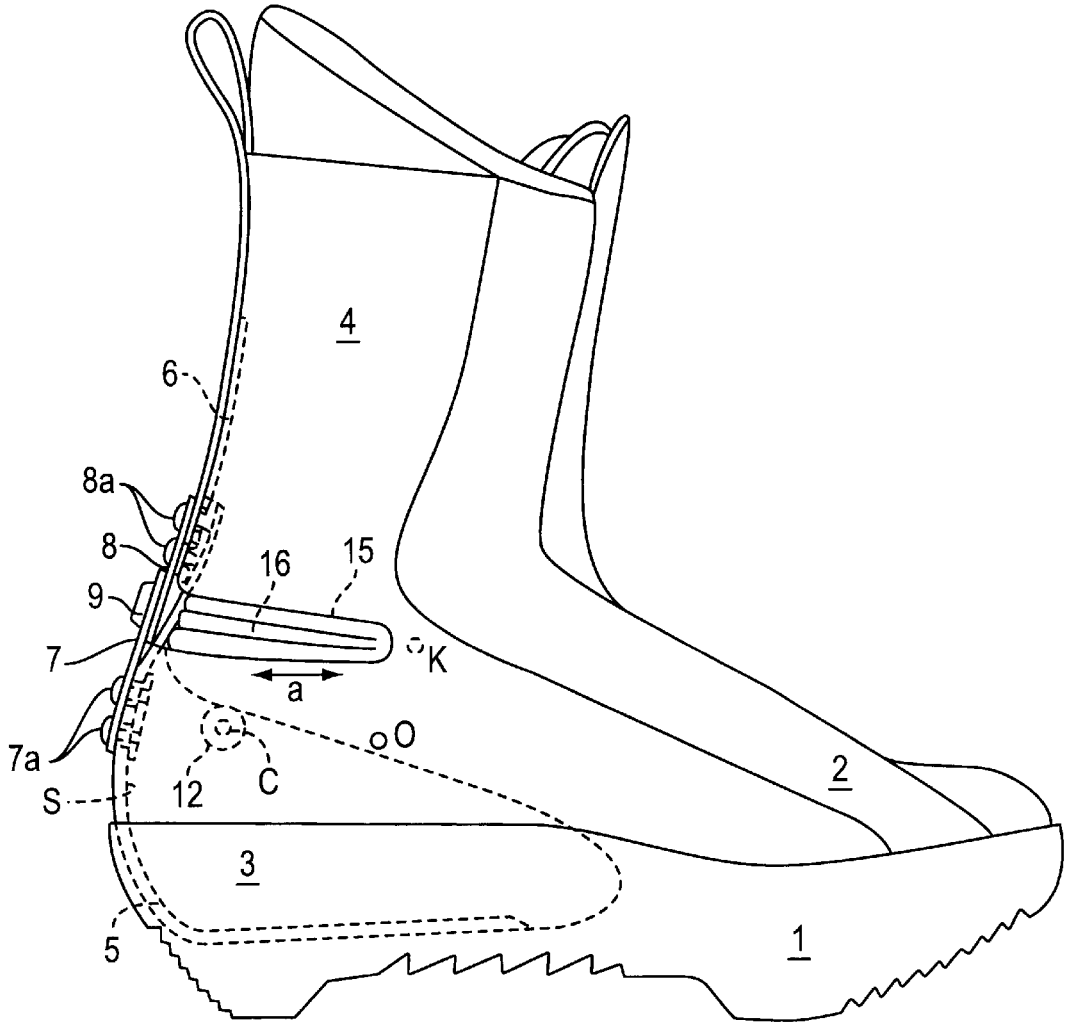
FIG. 1 is a side view of a snowboard boot.
Figure 5:
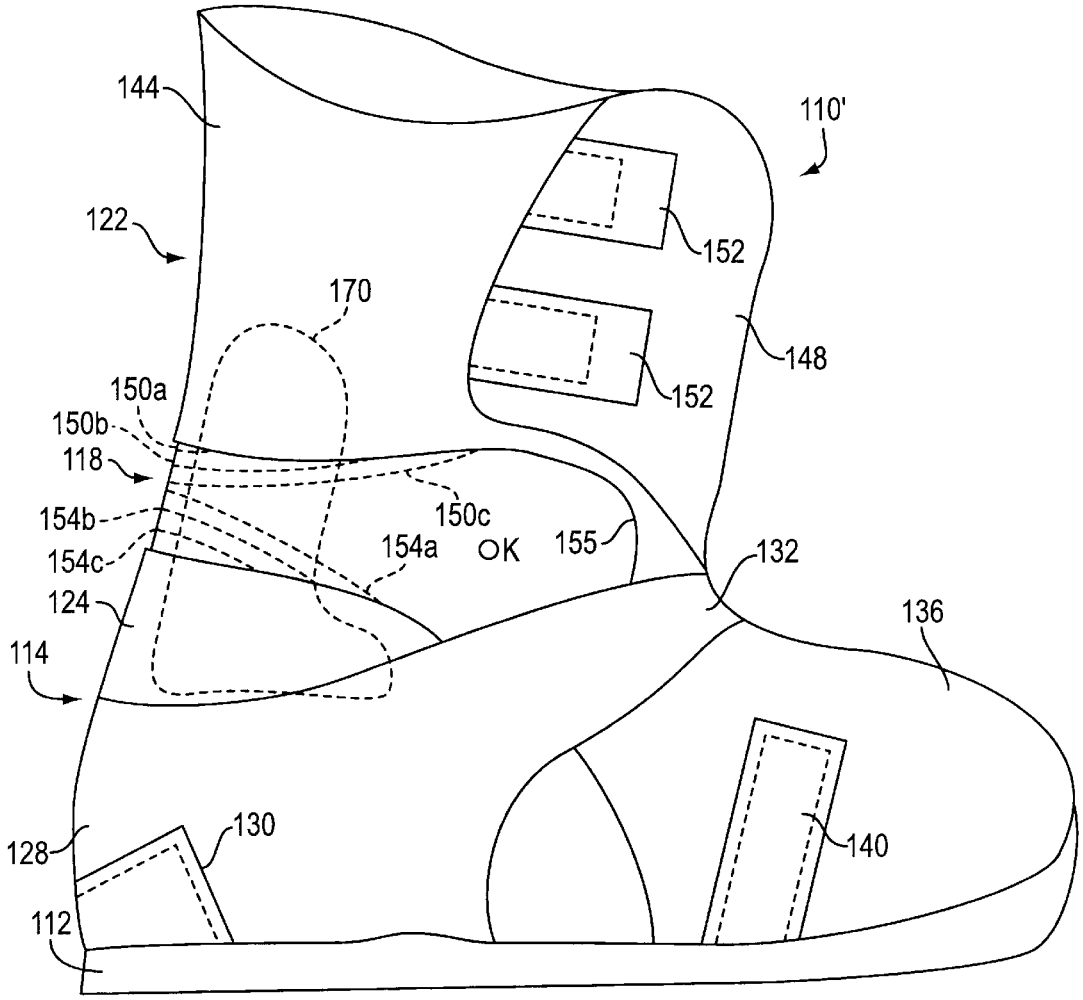
FIG. 5 is a side view of another alternative embodiment of a snowboard boot according to the present invention.

FIG. 5 is a side view of another alternative embodiment of a snowboard boot 110' according to the present invention. This embodiment is substantially the same as snowboard boot 110 shown in FIG. 1 but with the addition of an arcuate pad 170 stitched to inner heel cup 124, ankle portion 118 and rear leg support 144. Pad 170 usually is positioned to fit in the depression behind the anklebone, slightly above the heel bone and in front of the Achilles tendon to provide a firm fit for the boot. Stitch lines 150*a,* 150*b,* 150*c,* 154*a,* 154*b* and 154*c* help prevent pad 170 from stretching forwardly, thus interfering with the anklebone.

While the above is a description of various embodiments of the present invention, further modifications may be employed without departing from the spirit and scope of the present invention. For example, the size, shape, location or orientation of the various components may be changed as desired. The functions of one element may be performed by two, and vice versa. The present invention may be applied to any of the snowboard boots disclosed in U.S. patent application Ser. No. 08/736,233 noted above as well as any other snowboard boot. Thus, the scope of the invention should not be limited by the specific structures disclosed. Instead, the true scope of the invention should be determined by the following claims.

What is claimed is:

1. A snowboard boot comprising:

a foot portion defining a foot portion outermost surface of the snowboard boot;

an ankle portion formed of a flexible material disposed above the foot portion and extending forwardly;

a leg portion disposed above the ankle portion and defining a leg portion outermost surface of the snowboard boot;

wherein the ankle portion includes:

a first stitch line extending from a rear of the ankle portion forwardly, wherein the first stitch line is disposed at a portion of the ankle portion not overlapped by the foot portion, and wherein the first stitch line is disposed at a portion of the ankle portion not overlapped by the leg portion;

a second stitch line extending from the rear of the ankle portion forwardly so that the flexible material forms a flexible material space disposed between the first stitch line and the second stitch line and extending forwardly therefrom, wherein the second stitch line is disposed at a portion of the ankle portion not overlapped by the foot portion, and wherein the second stitch line is disposed at a portion of the ankle portion not overlapped by the leg portion; and wherein the flexible material space has no stitch line extending from the rear of the ankle portion therein.

2. The boot according to claim 1 wherein the flexible material comprises a fabric.

3. The boot according to claim 1 further comprising a pad disposed behind the flexible material space.

4. The boot according to claim 3 wherein the pad has an arcuate shape.

5. The boot according to claim 4 wherein the pad is attached to the ankle portion.

6. The boot according to claim 5 wherein the pad is stitched to the ankle portion.

7. The boot according to claim 1 wherein the first stitch line and the second stitch line are exposed to the outside of the boot.

8. The boot according to claim 1 wherein the first stitch line extends from the rear of the ankle portion forwardly and upwardly, and wherein the second stitch line extends from the rear of the ankle portion forwardly and downwardly.

9. The boot according to claim 1 wherein the ankle portion is one piece.

10. A snowboard boot comprising:

a foot portion defining a foot portion outermost surface of the snowboard boot;

an ankle portion formed of a flexible material disposed above the foot portion and extending forwardly;

a leg portion disposed above the ankle portion and defining a leg portion outermost surface of the snowboard boot;

wherein the ankle portion includes:

a plurality of first stitch lines extending from a rear of the ankle portion forwardly, wherein the plurality of first stitch lines are disposed at a portion of the ankle portion not overlapped by the foot portion, and wherein the plurality of first stitch lines are disposed at a portion of the ankle portion not overlapped by the leg portion;

a plurality of second stitch lines extending from the rear of the ankle portion forwardly so that the flexible material forms a flexible material space disposed between the plurality of first stitch lines and the plurality of second stitch lines and extending therefrom, wherein the plurality of second stitch lines are disposed at a portion of the ankle portion not overlapped by the foot portion, and wherein the plurality of second stitch lines are disposed at a portion of the ankle portion not overlapped by the leg portion; and wherein the flexible material space has no stitch line extending from the rear of the ankle portion therein.

11. The boot according to claim 10 wherein the flexible material comprises a fabric.

12. The boot according to claim 10 further comprising a pad disposed behind the flexible material space.

13. The boot according to claim 12 wherein the pad has an arcuate shape.

14. The boot according to claim 13 wherein the pad is attached to the ankle portion.

15. The boot according to claim 14 wherein the pad is stitched to the ankle portion.

16. The boot according to claim 10 wherein the plurality of first stitch lines and the plurality of second stitch lines are substantially evenly spaced vertically at the rear of the ankle portion.

17. The boot according to claim 10 wherein at least one of the plurality of first stitch lines and at least one of the plurality of second stitch lines are exposed to the outside of the boot.

18. The boot according to claim 10 wherein each of the plurality of first stitch lines and each of the plurality of second stitch lines are exposed to the outside of the boot.

19. The boot according to claim 10 wherein the plurality of first stitch lines extend from the rear of the ankle portion forwardly and upwardly, and wherein the plurality of second stitch lines extend from the rear of the ankle portion forwardly and downwardly.

20. The boot according to claim 10 wherein the ankle portion is one piece.

* * * * *